US006009951A

United States Patent [19]

Coronado et al.

[11] Patent Number: 6,009,951

[45] Date of Patent: Jan. 4, 2000

[54] METHOD AND APPARATUS FOR HYBRID ELEMENT CASING PACKER FOR CASED-HOLE APPLICATIONS

[75] Inventors: Martin Paul Coronado, Cypress; Rustom Khodadad Mody, Bellaire; Mark C. Solari, Houston, all of Tex.

[73] Assignee: Baker Hughes Incorporated, Houston, Tex.

[21] Appl. No.: 08/989,753

[22] Filed: Dec. 12, 1997

[51] Int. Cl.[7] ..... E21B 33/127

[52] U.S. Cl. ..... 166/387; 166/187; 166/191; 166/127; 277/331; 277/334

[58] Field of Search ..... 166/187, 387, 166/191, 127; 277/331, 334

[56] References Cited

U.S. PATENT DOCUMENTS

| | | | |
|---|---|---|---|
| 1,549,168 | 8/1925 | Townsend | 277/331 |
| 2,804,148 | 8/1957 | Schremp et al. . | |
| 3,182,725 | 5/1965 | Moore | 166/66.4 |
| 3,578,083 | 5/1971 | Anderson et al. | 166/285 |
| 4,349,204 | 9/1982 | Malone . | |
| 4,403,660 | 9/1983 | Coone | 166/387 |
| 4,424,861 | 1/1984 | Carter, Jr. et al. | 227/334 |
| 4,440,226 | 4/1984 | Suman, Jr. | 166/250.14 |
| 4,484,626 | 11/1984 | Kerfoot et al. | 166/191 |
| 5,101,908 | 4/1992 | Mody . | |
| 5,143,154 | 9/1992 | Mody . | |
| 5,184,677 | 2/1993 | Dobscha et al. . | |
| 5,197,542 | 3/1993 | Coone . | |
| 5,220,959 | 6/1993 | Vance, Sr. . | |
| 5,226,485 | 7/1993 | Dobscha et al. . | |
| 5,271,469 | 12/1993 | Brooks et al. . | |
| 5,488,994 | 2/1996 | Laurel et al. . | |

*Primary Examiner*—David Bagnell
*Assistant Examiner*—Chi H. Kang
*Attorney, Agent, or Firm*—Duane, Morris & Heckscher LLP; Steve Rosenblatt

[57] ABSTRACT

An inflatable packer having a sealing section, with noncontinuous ribs, is provided in combination with a ribbed element, which provides anchoring capabilities in tandem with the partially ribbed element which provides sealing capabilities in downhole applications.

19 Claims, 2 Drawing Sheets

METHOD AND APPARATUS FOR HYBRID ELEMENT CASING PACKER FOR CASED-HOLE APPLICATIONS

FIELD OF THE INVENTION

The field of this invention relates generally to an inflatable packer for use in wellbores, and specifically to an inflatable packer which has a hybrid elastomeric element design providing sealing capability and anchoring support for use in cased-hole applications. More particularly, but not by way of limitation, this invention relates to an inflatable packer where the sealing element acts independently of the anchoring element.

BACKGROUND OF THE INVENTION

The production for oil and gas reserves has taken the industry to remote sites including inland and offshore locations. In addition, hydrocarbon production in remote locations has become the "norm." For example, production in deviated and multi-lateral wellbores is now very common. As a result, new and unique problems, particularly, in the completion phases have arisen. Historically, the cost for developing and maintaining hydrocarbon production has been very high in remote locations. And as production continues in these remote areas, costs have also escalated because of the unique problems encountered in producing oil and gas in difficult-to-reach locations and/or producing hydrocarbon through numerous zones. As a result production techniques in these remote areas require creative solutions to unique problems not encountered in conventional wellbores.

As one skilled in the industry may understand, hydrocarbon production rates directly affect the profitability of a wellbore. During the productive life of these wells, the well must be maintained so that hydrocarbon production and retrieval is performed in the most efficient manner and at a maximum capacity. Well operators desire maximum recovery from productive zones, and in order to maximize production, proper testing, completion and control of the well is required.

In wellbore construction, four factors are a part of every wellbore design phase: (1) the completion method most suitable for a particular well, (2) the fluid flow paths needed, (3) the completion system chosen to bring the fluids to the wellhead, and (4) the completion cost versus the production potential. The completion method chosen is an important element, and this invention relates to proper zone isolation and the most effective and efficient means to do so. More particularly, it concerns zone isolation in cased wellbores. As one in the industry might expect today, multi-lateral wellbores require cased wellbores for efficient drainage through multiple zones and/or reservoirs. In addition, many operations conventionally performed at the surface are now performed downhole. As a result, cased-hole operations have become a necessity for many wellbore completions.

Thus, different tools are needed for each of two methods of completion: (1) open-hole completion and (2) cased or perforated completions. In an open-hole or a barefoot wellbore completion, a relatively large internal diameter is encountered and the open-hole shape is invariably skewed. The open-hole is irregular (not perfectly cylindrical) since the hole is drilled in the earthen formation. Therefore, the external casing packer became an ideally suited tool to isolate zones during production or cementing operations because of its large inflation and sealing capacity. In such completion methods, the external casing packer is part of the casing string and forms a seal and an anchor against the open-hole wall when an elastomeric element in the inflatable tool is inflated. The anchor in the open-hole is formed when the packer's elastomeric element is inflated and contours to the shape of the open-hole, preventing axial movement in the wellbore. The exceptional expansion and sealing capabilities of the flexible elastomeric elements allow these tools to handle conditions that would be impossible for conventional packing tools. When inflated, the packing element conforms to virtually any irregularity in open-hole completed wellbores. While no packing element can tolerate all conditions, the inflatable packing elements have been found to be very tolerant for open-hole completions.

On the other hand, in cased-hole wellbores, a different set of criteria and problems for completing and workover of a wellbore are encountered. One recent problem that has been encountered is to isolate a particular zone that is located below completion equipment already located in the wellbore. Such zones are normally very difficult to isolate since only limited access or through-pass in existing wellbore equipment is available to the zone below. Conventionally, such completion equipment has provided a relatively narrow access to a section located below. In such wellbores there is, therefore, a need for zone isolation packers that may be installed below any existing equipment. It is clear that conventional packer equipment may not be used in such wellbores since much of it comprises larger diameter equipment. Such equipment, therefore, cannot pass through the restricted available access.

In addition, conventional thru-tubing and production injection packer technologies are also inadequate in these applications since they do not and cannot provide sufficient sealing capability in larger diameter casing sizes when using an inflation medium that operates under a phase change condition. Examples of a phase change medium include cement or epoxy. Phase change of an inflation medium occurs after the inflation medium sets. An inflation medium sets when it retains a permanent phase. For example, a phase change occurs when cement or epoxy hardens. However, subsequent to such hardening, another phase change occurs such that the cement or epoxy shrinks slightly.

In these restricted access wellbores, conventional production injection packers and thru-tubing technology using phase change inflation media cannot be inflated to reach the outer diameter (OD) of the cased wellbore (the wall) to effectively seal a zone for reasons that will be discussed hereinafter. Thus, a new zone isolation tool is greatly needed to isolate certain zones in the cased wellbore.

One concept is to use conventional external casing packer technology, now used in larger diameter open-hole completions, to anchor and seal (isolate) a particular zone, especially since they have a relatively small "pass-through" OD and thus are capable of passing through the restricted access of existing equipment. Examples of these conventional packer technology include "production injection packers" and "thru-tubing packers." However, even with improving elastomer technology, these conventional packers have proven to be relatively ineffective in applications requiring inflation in a cased wellbore with a phase change medium.

In order to understand why this is so, it is first necessary to review the design of these (inflatable) packers. Inflatable packers have long utilized a design incorporating the use of various elastomeric elements in combination with metal slats or ribs as inflatable elements. Such inflatable tools comprise an elastomeric sleeve element mounted in surrounding relationship to a tubular body portion. To protect the elastomeric sleeve element, a plurality of resilient slats or ribs are peripherally bonded to the elastomeric sleeve element. The medial portion of the elastomeric sleeve is further surrounded, and may be bonded, by an outer annular elastomeric sleeve element or "cover" of substantial thickness. These prior art external casing packers thus use a "full cover" design. Upper and lower assemblies securely and sealingly couple the ends of the packing element sleeves to the central tubular body. A pressurized phase change inflation medium is communicated to the tubular body and then through radial passages thereon to the interior of the elastomeric sleeve element to inflate the packing elements, providing a sealing radial engagement with the wellbore wall.

A conventional external casing packer (with or without a phase change medium) is ineffective in cased-wellbore applications because the contour of the casing is sufficiently cylindrical, thus preventing a proper anchoring relationship between the external casing packer and the casing wall. One reason a proper anchor does not result is because the coefficient of friction between the elastomeric element and the steel casing in a wetted media environment is very low. Thus, the differential pressure in the wellbore between locations above and below the packer forces its movement.

In addition, the conventional external casing packer is designed to provide only anti-extrusion benefits. For example, the ribs are located only on the secured ends (securing assemblies) of the elastomeric element and thus provide only limited anchoring benefits. As such, the elastomeric element has a tendency to "roll over" or overlap the secured end when a sufficient axial force is applied to the ribs. On the other hand, if a modification is made and the elastomeric element is fully ribbed, another disadvantage arises. In the latter case, a full length rib elastomeric element, in combination with the elastomeric element, is a much larger OD packer. Therefore, a new design requires a thinner cover to overcome the limited access available through existing downhole equipment.

However, when a thinner cover is introduced in the new design, another significant problem arises when a phase change inflation medium is used to inflate the inflatable packer in the cased wellbore. This new problem arises when the inflation medium changes phases (cures and contracts) and there is a resulting loss of radial force available against the casing wall. It is understood by one skilled in the art that a relatively thicker elastomeric element normally makes up this differential in radial force. However, when a thinner element is used, the loss in radial force may not be compensated or "made up." Thus, the amount of compensation an elastomeric element can "make-up" is a function of its thickness. Stated differently, the energy storage capacity of the elastomeric element available for sealing engagement is a function of its thickness. Thus, as a relatively thicker elastomeric element is used, a relatively larger energy storage potential exists. This larger stored energy potential is available to act against the cased-wellbore wall in sealing engagement, compensating for any shrinkage in the inflation medium. In a cased wellbore, therefore, a relatively thick elastomeric element is required to obtain proper sealing capability. Thus, there is a need for a new zone isolation tool that overcomes all of these limitations.

Various prior art external casing packer devices have existed, but none provide a solution for isolating a zone below existing equipment that has restricted access in a cased wellbore environment. For example, Mody, et. al., discloses in U.S. Pat. No. 5,143,154 an inflatable packing element for an inflatable packer having a specific rib coupling design to the tubular mandrel.

Another teaching is that by Mody in U.S. Pat. No. 5,101,908 for an inflatable packing device and a method for sealing. The device discloses upper and lower elastomeric elements surrounding a tubular mandrel. Again, however, this teaching is not directed to the problems encountered herein.

Another teaching is that of Halbardier in U.S. Pat. No. 4,869,325, disclosing a method and apparatus for setting, unsetting, and retrieving a packer or a bridge plug from a subterranean well which may be passed though a small diameter tubing. However, again, such a teaching is not directed to the specific problems encountered herein.

Therefore, there is a need for a method and apparatus for an inflatable tool that provides a solution for isolating zones through restricted access completion equipment in a cased wellbores that provide both a seal and anchoring features.

SUMMARY OF THE INVENTION

The present invention is directed to a new and improved wellbore packing device for use in isolating zones within a subterranean wellbore and to methods for applying the packing device in a cased-hole application. The present invention is directed to a new and improved inflatable or external casing packer (ECP) for use in cased wellbores. A hybrid inflatable packing element design in an ECP is presented, having in a single-unit, anchoring and sealing sections for application in cased wellbores using a phase change inflation medium such as cement or epoxy or the like. The present invention overcomes limitations of existing prior art ECP's since these prior art ECP's are not capable of providing both sealing and anchoring packing elements in a single unitized design in size and access restricted wellbores.

The inflatable elements comprise a sealing section that uses a noncontinuously reinforced elastomeric element with anti-extrusion ribs at its ends. When filled with the inflation medium, a frictional, radial force sealingly engages the elastomeric element with casing wall. An anchoring section is also provided that uses a continuously ribbed elastomeric bladder element. The steel ribs on the surface of the elastomeric element engage in metal-to-metal contact with the casing wall as the inflation medium exerts a frictional, radial force. Any trapped wellbore fluid between the sections escapes via the pathway between the ribs. A method for use of the hybrid ECP is also disclosed. More specifically, a method for use of the hybrid inflatable packer in a cased-hole environment with a phase change inflation media is presented.

DETAILED DESCRIPTION OF THE PREFERRED EMBODIMENT

Figure 1A:
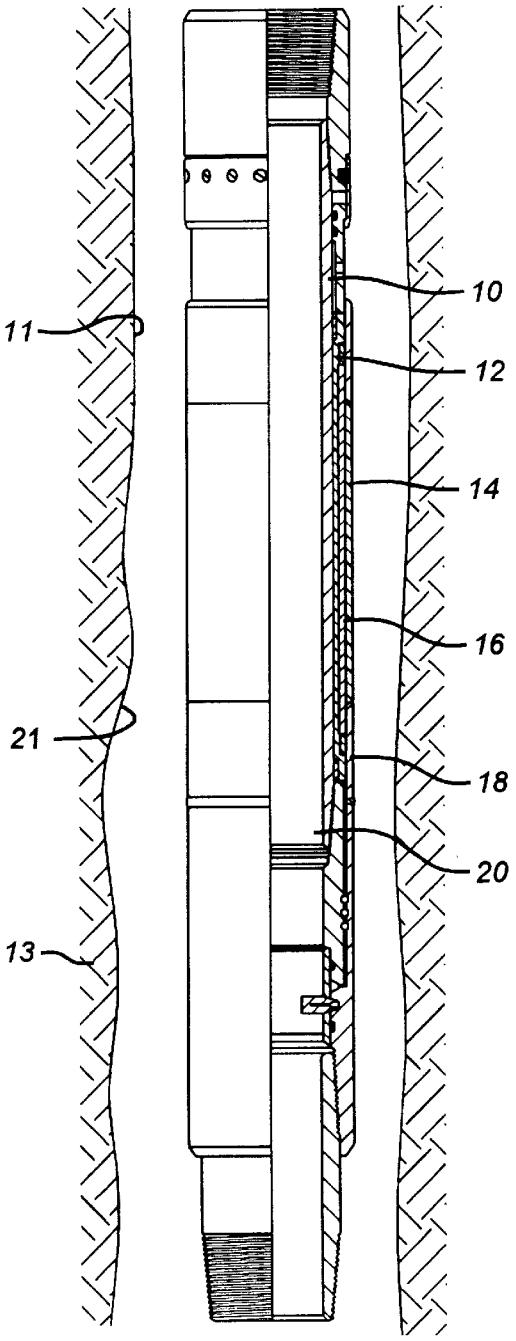
(PRIOR ART) FIG. 1A
FIG. 1A is a cross-sectional and perspective combination view of the prior art external casing packer, showing a continuous ribbed style inflatable element.
Figure 1B:
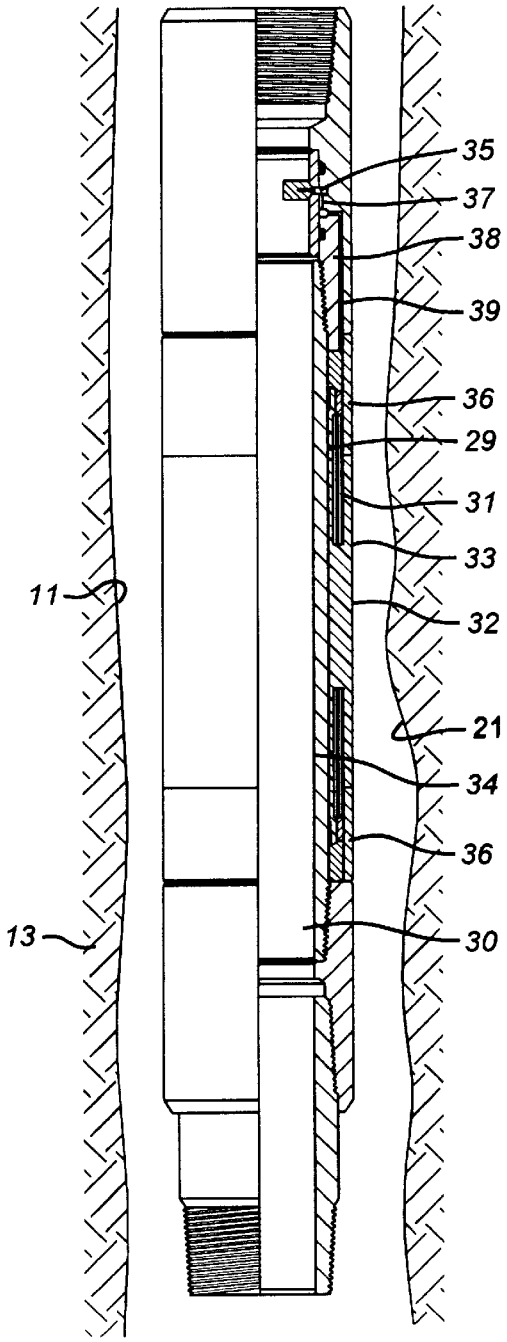
(PRIOR ART) FIG. 1B
FIG. 1B is a cross-sectional and perspective combination view of the prior art external casing packer, showing a noncontinuous style inflatable element.

The present invention is best described and understood with reference to the context in which it is used and the prior art designs of external casing packers (see FIGS. 1A & 1B).

Thru-tubing workover and completion technologies have significant advantages, particularly since they provide isolation in restricted access zones. However, some operating and design limitations exist in such technologies. For example, thru-tubing technologies are sized smaller and therefore are limited in larger diameter wellbore applications. In cased wellbores, significant pressure differentials exist within the wellbore when flowing wellbore fluids are present and, thus, unintended displacement of settable or inflatable tools occurs. Flow in either direction usually exists in a wellbore when a producing zone is in hydraulic communication with a consuming zone and such inter-zone "cross-flow" may exist in a wellbore, irrespective of whether flow is directed to the surface.

Inflatable wellbore tools are operable in a number of modes, such as the "run-in" mode of operation, an "expansion or inflation" mode of operation, and a "setting" mode of operation. The inflatable tool is maintained in a run-in condition during entry of the tool into the wellbore in a reduced radial dimension so that the tool may pass through restricted access areas. Once the inflatable tool is passed beyond the restricted access area and placed in a desired area, inflation pressure is applied to the tool with an inflation medium so as to urge it into a radially outward direction in an inflated condition. Such radial expansion, at least in part, obstructs the flow of wellbore fluid within the cased wellbore.

The obstruction created by the inflatable tool frequently creates a pressure differential across the inflatable tool. Most commonly, this occurs when the inflatable tool is set above a producing zone. Wellbore fluids, such as oil, gas and water, will continue flowing in the wellbore due to a pressure differential between the formation and the wellbore, as well as pressure differential between zones. Thus, wellbore fluid flow may urge the inflatable tool to move, rotate, twist and/or slide, especially in a wetted environment of a cased wellbore. The unintended, and often harmful, displacement of the inflatable tool often occurs because currently available prior art thru-tubing technologies do not provide adequate anchoring means. Such anchoring means are traditionally found in tools having "gripping teeth," as those found in the more conventional metal-to-metal packer devices. Thus, for example, coiled tubing-suspended inflatable tools do not provide sufficient anchoring means to prevent displacement and are not often used in such applications. Obviously, the mechanical packers are simply not appropriate for restricted access applications.

Additionally, if a pressure differential is developed across the inflatable tool, the pressure differential may act to disconnect the inflatable tool from the suspension tool or means. Thus, for example, in a wireline-suspended tool, a large pressure differential could snap the wellbore tool loose from the wireline cable. Alternatively, a high-pressure-sensitive or tension-sensitive disconnect device used in connection with coiled tubing or production string operations may easily actuate and disconnect the packer device from the coil tubing or production string.

With respect to prior art designs, such as open-hole inflatable packer devices, a continuous ribbed style external casing packer (ECP) 20 is shown in FIG. 1A and a noncontinuous ribbed styled ECP is shown in FIG. 1B. The continuous ribbed style ECP 20 provides a long dynamic hydromechanical seal using an elastomeric element 14 combined with continuous stainless steel ribs 16 to protect the inflatable elements 12,14 from the tremendous multidimensional strains existing in nonuniform wellbores. The steel ribs 16 are utilized to provide strength, flexibility and long-term reliability against tear of the inner elastomeric element 12. These inflatable elements 12,14 are mounted on the mandrel or inflatable tool 10 by securing assemblies 18 on each end. This ECP 20 is particularly useful for short- or long-length seal applications requiring positive seals in high differential, irregular, or elliptical open-hole wellbores. The continuous ribbed ECP uses various inflation media, including water, drilling fluids and/or cement.

The noncontinuous ribbed ECP 30, on the other hand, is used as a supplemental packer to the continuous ribbed ECP 20 during special applications requiring longer sealing elements and utilizing cement, mud, fluid or epoxy as the inflation medium. It may include a valve collar 38 that features an enlarged inflation flow capacity and a flow control that decreases the erosion of the valve seats 35, seals (not shown) and the inflation passageway 39. The ribs 31 are located only on the secured ends 36 of the elastomeric element and thus provide only limited anchoring benefits. The ribs 31, as previously stated, provide strength at the end sleeve area 36 and also where the ribs engage 33 the wellbore wall 11. The nonreinforced center or medial portion 32 creates a flexible expansion area which readily conforms to open-hole irregularities 12, providing an adequate seal.

In an open-hole wellbore completion as shown in FIG. 1, a relatively large diameter is encountered in the wellbore, and the open-hole wall 11 is invariably skewed or irregular 21 (not perfectly cylindrical) since the hole is drilled in the earthen formation 13. Therefore, the conventional ECP 20,30, as described above, became an ideally suited wellbore tool to isolate zones in such environments during production or workover operations because of the large inflation capacity of its inflatable elastomeric element. In such open-hole operations, the ECP is part of the casing string and forms a "sealing" anchor against the open-hole, irregular wall 12.

The "sealing" anchor in the open-hole wellbore is formed when the packer's elastomeric element 14 is inflated and contours to the shape 21 of the open-hole, preventing axial movement in the wellbore. Axial movement is prevented because of multidimensional forces acting radially against the wellbore wall 11. In addition, these prior art ECP's use a "full cover" elastomeric element design. A full cover design wraps the full length of the inner elastomeric element 12, 29 with an outer elastomeric element 14,32. In the alternative, the noncontinuous metal ribs 31 (FIG. 1B) are fabricated inside the elastomeric cover 32 and are coupled to the end sleeves 36 so as to provide reinforcement against extrusion when the element 32 is inflated. Thus, the exceptional expansion capability of the flexible elastomeric element allows for use of these ECP tools in conditions that would be otherwise impossible for conventional (mechanical) packing tools.

However, as previously mentioned, these prior art ECP's 20,30 are limited in application to open-hole operations. In cased-wellbore applications, these prior art ECP's 20,30 are inadequate because the contour 55 of the casing 54 is sufficiently cylindrical. The uniform cylindrical shape of the casing wall 54 prevents a proper or adequate anchoring relationship between a conventional ECP 20,30 and the casing wall 54.

One reason a proper anchoring relationship, in the conventional ECP's 20, 30, does not result is because the coefficient of friction between the elastomeric element 14,32 and the steel casing 54 in a wetted media is very low. Thus, the differential pressure in the wellbore between locations above and below the packer results in movement or displacement of the packer and which normally results in great damage to the well, particularly in loss of production and the resulting economic damages.

In addition, the conventional, noncontinuous ribbed style ECP 30 is designed such that the ribs 31 are only located on the secured ends 36 of the elastomeric element 32 and thus provide only limited anchoring and/or anti-extrusion benefits. As such, the elastomeric element 32 has a tendency to "roll over" or overlap over the secured end 36 near the end sleeves 33 when a sufficient axial force is applied to the ribs 30. On the other hand, if a modification is made so that the elastomerlc element 32 is fully ribbed, another problem arises. A full length ribbed elastomeric element 14, as shown in FIG. 1A, becomes a much larger diameter inflatable element 14 and therefore requires a thinner elastomeric cover 14 so that the ECP 20 may pass through existing equipment (not shown), having only limited or restricted access to the zone beyond.

However, when a thinner elastomeric cover 14 is used, a significant disadvantage results in providing adequate sealing protection. It should be understood that the inflatable tool is being applied to cased wellbores, using a phase change medium to inflate the element. Thus, when the phase change inflation medium cures, there is a loss of radial force available against the casing wall as the inflation medium changes its phase, i.e., the inflation medium contracts or shrinks as it hardens, resulting in loss of available radial force or energy against the wellbore wall. It is clear to one skilled in the art that the elastomeric element normally makes up the difference in radial force loss through the resiliency of a relatively thicker elastomeric cover, i.e., the relatively thick elastomeric cover stores a certain amount of radial force energy upon the expansion of the inflation medium and releases this stored energy to compensate for any phase changes in the inflation medium, such as shrinkage or contraction. The amount of energy storage available to compensate for shrinkage force loss is clearly a function of the elastomer thickness. In a cased wellbore, therefore, a relatively thick elastomeric cover is necessary to obtain proper sealing capability. This thicker cover design requirement, however, conflicts with having only limited access through the downhole equipment in cased wellbores. Thus, there is a need for a new zone isolation inflatable tool that overcomes all of these limitations.

Figure 2:
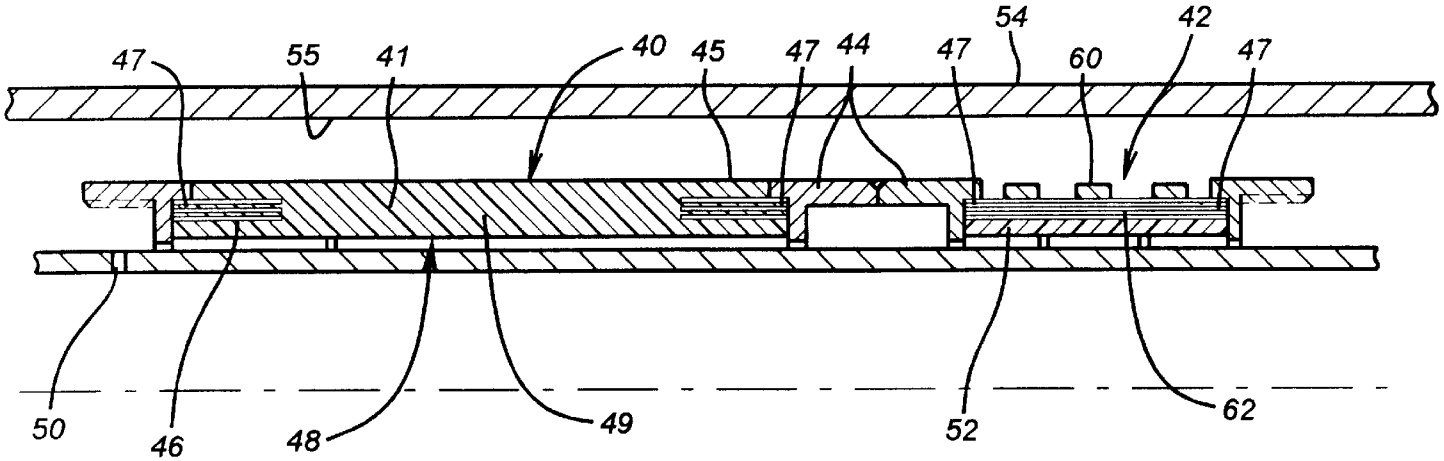
FIG. 2 is a cross-sectional view of a hybrid external casing packer of the preferred embodiment, showing a sealing inflatable element section and an anchoring inflatable element section as it would appear in the run-in mode of operation.
Figure 3:
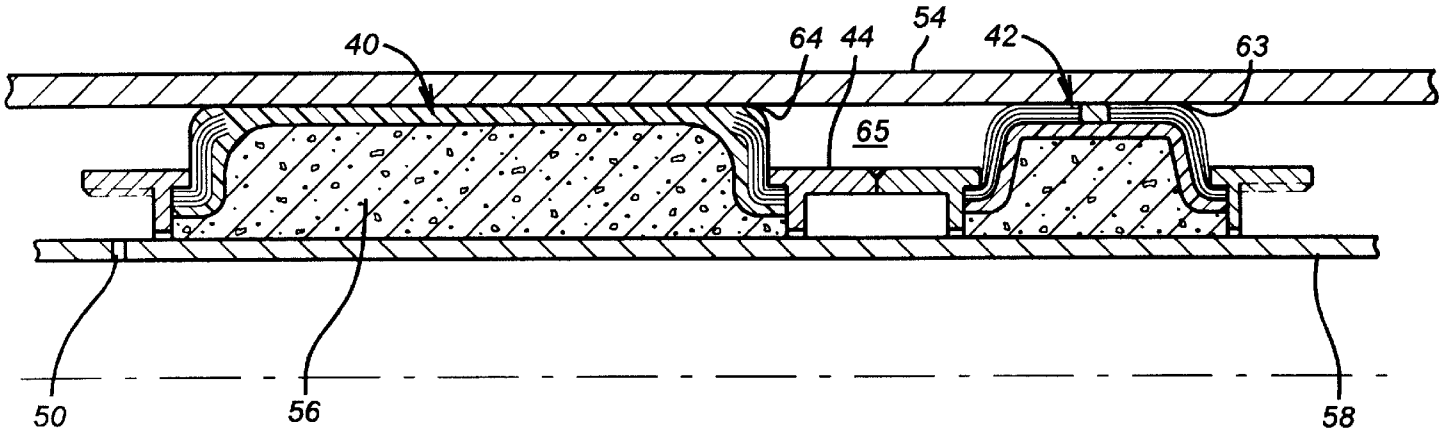
FIG. 3 is a cross-sectional view of a hybrid external casing packer of the preferred embodiment, showing a sealing inflatable element section and an anchoring inflatable element section as it would appear in the inflation mode of operation.

Referring now to FIGS. 2 and 3, a new inflatable tool design is disclosed which overcomes many of the limitations discussed above. In the preferred embodiment, the new inflatable tool design uses a sectioned element design to provide two of the most important requirements in cased-wellbore applications when using phase change inflation media: (1) sealing ability, and (2) anchoring capability.

In the preferred embodiment, the sealing feature 40 is provided with a full cover elastomeric design 45 having a relatively large thickness 41 while the anchoring feature 42 is provided with an exposed full length or continuous ribbed design 62 providing metal-to-metal contact 63 with the casing wall 54. The full cover elastomeric design 45 of the sealing element section 40 provides the necessary elastomeric thickness 41 to compensate for phase change losses in radial sealing force. On the other hand, the full length exposed rib element section 42 provides a metal-to-metal engagement 63 between the anchoring element 62 and the casing wall 54 so as to create sufficient anchoring force in the cased wellbore.

The two sections 40,42 are separated by end sleeves 44 which couple each respective element 40,42 to the tubular body 58 of the inflatable tool. The method for coupling each respective element 40,42 is well-known in the art and is disclosed in U.S. Pat. No. 5,143,154 and the specification of said patent is hereby incorporated by reference. In addition, the features of the valve apparatus (not shown) for proper inflation of the elastomeric elements is well-known in the art. See, for example, U.S. Pat. No. 4,708,208; U.S. Pat. No. 4,805,699; and U.S. patent application Ser. No. 138,197, filed on Dec. 28, 1987. All such disclosures are incorporated by reference. The end sleeves 44 are mechanically coupled to the tubular body 58 by conventional techniques such as threaded sleeves (not shown).

Referring now to FIG. 2, one embodiment of the invention, a hybrid inflatable tool, is shown in the run-in condition. The sealing section 40 comprises elastomeric element 48 supported by noncontinuous anti-extrusion ribs 46. The sealing section 40 is preferably placed in the direction away from the conveyance device (not shown), while the anchoring section 42 is placed near the conveyance device. However, this by no means is a limitation to the present invention.

Opposite ends 45 of the sealing element 48 are coupled 47 to the tubular member 58 with end sleeves 44. The anti-extrusion ribs 46 are mechanically coupled to the end sleeve 44 in accordance with conventional methods that are well-known in the art and incorporated by reference herein. The noncontinuous, nonreinforced rib design of the sealing element 40 provides the necessary thickness 41 to compensate for radial force loss from phase change in the inflation medium 56. Yet, the thickness 41 of the sealing element 48 provided overcomes any access and size restrictions of existing equipment already located downhole as will become more apparent hereinafter.

The inflatable tool element 48 in the sealing section 40 is not reinforced in the medial portion 49 of the elastomeric element 48 and as such does not have ribs 46 extending end to end. Such a design clearly compensates for having a relatively large thickness 41 elastomeric element 48 because the ribs 46 are eliminated in the medial portion 49. The ribs 46 are only provided at the ends 45 where the sealing element 48 is connected to the tubular mandrel 58 to support the end load. The medial portion 49 is simply made of elastomer, and thus, a thicker 41 elastomer may be provided. However, anchoring is not possible in cased wellbores under such circumstances. In open-hole, the anchoring results from the rough noncontinuous surface of the wellbore while the casing has a smooth surface 55 and the result is that gripping does not occur. Anchoring is, however, provided by a separate but related section 42.

In the preferred embodiment, the anchoring element section 42 comprises an inner tube or bladder 52 that is inflated, the anchor ribs 62 and an elastomeric stiffener band 60 to uniformly space the ribs 46 along the periphery of the inner tube 52 may be added. The ribs 62 are made of steel and are exposed so as to engage in a metal-to-metal relationship 63 with the wellbore casing 55. The ribs 62 are mechanically coupled to a ring (not shown) and fitted inside the end sleeves 44. The exposed steel ribs 62 may be run in a high-pressure differential environment and yet still maintain metal-to-metal friction 63 for a strong anchoring relationship. In certain applications, such as short-length packers, the bands 60 are not needed.

Thus, the hybrid design of the present invention presented herein discloses an inflatable tool overcoming traditional cased-wellbore limitations and restrictions and yet having an inflatable unitary element design providing sealing and anchoring provisions and which are in pressure communication relative to each other. Thus the combined design has two elements 40,42 providing independent functions while inflating relative to each other. The anchoring element 42 only functions as an anchor while the sealing element 40 only functions as a seal.

In the preferred embodiment, the elastomer compounds 48,52 included in the design for the cover includes materials that have good memory for returning to the original size and developed for use in sub-zero surface conditions to avoid impact damage to the element surface during on-site handling. The temperature range for the elastomeric elements range from ambient to more than 500° F. depending on the type of elastomer used. It should be noted that the current invention does not, however, depend on the type of elastomer used. New elastomer technology with large temperature tolerances may just as easily be incorporated herein. The temperature ranges disclosed herein only represent currently available elastomer technology.

Each of the sealing and anchoring elements 40, 42 can be inflated with a phase change inflation medium 56 such as cement, epoxy or other such media. Thus, with today's expanding cement technology, a certain amount of contraction or shrinkage occurs in the inflation medium 56 during the curing or phase change stage. The present invention overcomes this limitation even when using phase change inflation medium 56 susceptible to radial force losses such as cement which suffers contraction at cured stage.

Referring now to FIG. 3, one of the embodiments, the present invention is shown as an expansion or inflation mode of operation and a set mode of operation. In the sealing element section 40, the inflatable elastomeric element is in full expansion, exerting a radial force against the casing wall 55. The radial force from a pressurized inflation medium 56 creates a sealing engagement 64 between the elastomeric element 48 and casing wall 55. As a result, wellbore fluids are prevented from having cross-flow, and the area above and below the inflatable tool are isolated form each other. The compressive force or frictional engagement 64 between the elastomeric element 48 and the casing wall 55 assures a fluid-tight seal.

The anti-extrusion ribs 45 in the sealing element section 40 provide protection against the elastomeric element 48 from rolling over as the element 48 is inflated under a relatively large pressure force. In addition, the ribs 45 provide protection against the elastomeric element 48 tearing and failing.

The anchoring element section 42 of the preferred embodiment is also shown in an inflated position in FIG. 3. The steel or other suitable metal ribs 62 provide a strong anchor against rotation, axial movement, twisting action, or any other type of displacement. Such movement is prevented because a large radial force acting on the ribs 62 from the inflation medium 56 pushes it into frictional engagement 63 with the casing wall 55. The exposed ribbed anchoring section 42 comprises a continuous rib element 62. Stated differently, the ribs run across the whole length of the elastomeric element and are coupled at the ends 47 to the end sleeves 44. The end sleeves 44 are, in turn, mechanically coupled to the tubular mandrel 58 by conventional means well-known in the art such as threaded sleeves (not shown herein). The inner tube or bladder 52 is fabricated under the ribs 62 which are similarly coupled to the end sleeves 44. The inner tube 52 acts as a containment member for the inflation medium 56. The end sleeve 44 not coupled to the sealing section operates in a sliding relationship relative to the tubular mandrel 58. It should be understood that the elastomeric band 60, in the anchoring element section 42, is provided so that the ribs 62 are evenly spaced-apart, and it is not intended to provide sealing capacity. In fact, the band 60, even though engaged with the casing wall 54, need not provide a pressure seal since its main function is to create a pathway (between the ribs 62) for the escaping fluids in the annulus 65 between the inflatable tool and the casing wall 54. The stiffener rings 60 typically range in number from zero to ten, depending on the size of the packer.

It should be understood that the preferred embodiment of hybrid inflatable tool progressively inflates, first inflating the sealing section 40 and then the anchoring section 42, due to the differences in the stiffness between the elements in each section. This provides an important advantage in that fluid will not be trapped between the two sections in the annulus 65 near the mechanical link 44 during the inflation operation. Fluid trapping is further prevented because the anchoring section 42, with its exposed ribs 62, creates a pathway for any trapped fluid to escape through passageways between the ribs 62.

The elements 40,42 may be inflated in a conventional manner. The inflating medium 56 is injected through a receiving port 50 which communicates with the inflatable elements 40,42. The inflation medium 56 should enter the port 50, preferably at the top end of the packer, and inflate the first component (preferably the sealing element 40) and then the inflating medium 56 bypasses the end sleeves 44 and progressively inflates the second component (preferably the anchoring element 42) of the tool. In the preferred embodiment, there are multiple ports or pathways 50 provided for inflating the elastomeric elements 40,42. The inflation fluid 56 enter these ports 50 and simultaneously inflate the elements 40,42 relative to each other. However, the inflatable sections 40,42 can function independently of each other. They can, however, be inflated under a single unitary operation. The inflation features of the present invention may further incorporate the conventional design of having the flow pathways approach the inflatable tool in a "valve collar up" inflation mode (not shown), i.e., the inflation medium pathway begins at the valve collar from the conveyance side. In such an inflation mode design, the inflation ports are placed at the top of the inflatable tool, i.e., the valve collar is placed away from the free or floating end and near the coupled end or conveyance end. Thus, inflation will occur from the valve collar side. However, it should be noted that an unconventional design of "valve collar down" works equally well, depending upon the wellbore conditions and requirements.

The placement of anchor and sealing sections 42, 40 relative to the conveyance device may be made interchangeably, i.e. the sealing element 40 may be near or away from the conveyance device. The decision to place the sealing element near the conveyance device (on top) is dependent on many factors and wellbore requirements including the ease with the inflation may occur. It is preferable to place the anchor section 42 near the "floating" end.

In the preferred embodiment, the sealing element 42 is placed near a mechanical "tie-in" or conveyance device (tubing string on the top side or the like) because the floating end "draws" up as the anchoring element is inflated. Thus, as inflation occurs, the axial length of the anchoring element 42 shortens to compensate for the radial inflation. Thus, the bottom end, including the anchoring element and the bottom-most end sleeve 44, slides as the anchoring element is inflated and drawn up and ultimately engages in an anchoring relationship 63.

In the case where the sealing section 40 is on the bottom, the anchoring section 42 draws "down" and engages 63 as it inflates providing compensation provisions are made so that the anchoring section may slide axially. In this case, the sealing element 40 inflates relatively ahead of the anchor element 42 and the draw down occurs during this period due to the stiffer anchoring element 42 (with the ribs 62) and thus inflating slower than the sealing element 40.

A number of inflatable tools in series may just as easily be inflated. For example, a Selective Inflation Packer System SCIPS™ (not shown) discloses complementary tools which cooperate with the present invention to run-in, activate or inflate and set the hybrid inflatable tool disclosed herein. The SCIPS™ tool is designed for horizontal or vertical wellbore applications requiring selective cement or epoxy inflation of inflatable tools. Noncontaminated cement is spotted for inflation purposes into the inflatable tool. The SCIPS™ tool allows selective inflation of and movement between staggered inflatable tools located in slotted liners, predrilled liners or screens without the loss of the inflation medium during repositioning. The SCIPS™ tool may be run-in together with the inflatable tool's or by itself on a second run after the casing or liner string has been run-in. In addition, all remaining unused cement may be reverse circulated. As elements are inflated, both the sealing and anchoring element sections expand to the casing wall progressively as a volume change of the cement occurs.

By using a sectioned element design of the preferred embodiment, i.e., the sealing and anchoring element sections, which are mechanically linked and in constant pressure communication, the present invention can achieve the benefits of both sealing and anchoring in a single-unit inflatable tool when used in a cased wellbore and a phase change inflation medium is used, and thus creating substantial savings for the operator.

The method by which the present invention is used in the cased wellbore does not depart substantially from existing and current methods. The inflatable tool of the present invention may be lowered into the cased wellbore using any number of conventional methods such as wireline, coiled tubing, production tubing, and the like. The only limitation is that the inflatable tool be capable of accessing and bypassing existing downhole equipment. Such a limitation is overcome by the present invention and is directed at overcoming this limitation. The present invention anticipates a relatively small OD operation and therefore is capable of being lowered under such conditions to the appropriate location in the cased wellbore. Once correctly located, the inflatable tool may be inflated into a sealing and anchoring engagement with the casing wall. Such inflation is accomplished as previously discussed herein. Inflation media may vary, depending on the anticipated use, but it is contemplated under the present invention to be a phase changing fluid which is settable and may incur slight shrinkage.

The foregoing disclosure and description of the invention are illustrative and explanatory thereof, and various changes in the size, shape and materials, as well as in the details of the illustrated construction, may be made without departing from the spirit of the invention. from the spirit of the invention.

We claim:

1. A downhole inflatable packer for sealing against a cased wellbore wall, comprising:

a body;

a movable sealing section, inflatably operable between a run-in position and a set position where it sealingly contacts the wall;

at least one movable anchor section inflatably operable between a run-in and a set position where it contacts the wall to support said body; and said sealing section is nonoverlapping with said anchor section;

said sealing section comprises a first resilient element;

said anchor section comprises a second resilient element which is nonoverlapping with said first resilient element; and said first resilient element being thicker than said second resilient element.

2. The packer of claim 1, wherein:

said first resilient element is of sufficient thickness to retain sealing contact with the wall if an inflation medium experiences shrinkage as it sets.

3. A downhole inflatable packer for sealing against a cased wellbore wall, comprising:

a body;

a movable sealing section, inflatably operable between a run-in position and a set position where it sealingly contacts the wall;

at least one movable anchor section inflatable operable between a run-in and a set position where it contacts the wall to support said body; and said sealing section is spaced apart from said anchor section;

said sealing section comprises a first resilient element;

said anchor section comprises a second resilient element; and said first resilient element being thicker than said second resilient element;

said first resilient element comprises ribs which are located adjacent to at least one of opposed ends and do not extend continuously over its length.

4. The packer of claim 3, wherein:

said second resilient element comprises continuous ribs extending over a majority of the distance from end to end.

5. The packer of claim 4, wherein:

said second resilient element further comprises at least one band mounted over said ribs.

6. The packer of claim 5, wherein:

said resilient elements when inflated define a cavity between said body and the wall, with said ribs allowing fluid in said cavity to pass by.

7. The packer of claim 6, wherein:

said first resilient element inflates before said second resilient element.

8. The packer of claim 3, wherein:

said first resilient element comprises an outer surface which contacts the wall and said ribs are disposed beneath said outer surface so that they do not contact the wall in said set position.

9. The packer of claim 4, wherein:

said ribs in said second resilient element extend from end to end thereof and are exposed for contact with the wall in said set position.

10. The packer of claim 4, further comprising:

a sleeve on said body between said first and second resilient elements; and said ribs on said first and second resilient elements connected adjacent opposite ends of said sleeve.

11. The packer of claim 10, wherein:

said sleeve is movable with a respect to said body.

12. The packer of claim 11, wherein:

said body comprises at least one port to facilitate inflation of said resilient elements.

13. The packer of claim 12, wherein:

said body has an upper and lower end, with said upper end comprising a connection to a conveying device to run said body into the wellbore; and said first resilient element is located closest to said upper end.

14. A method of sealing a cased borehole, comprising:

providing on a body an inflatable packer with a discrete inflatable element for sealing and a separate nonoverlapping inflatable element for anchoring;

providing a greater thickness on said inflatable element for sealing as compared to said element for anchoring;

running in said body into position; and inflating both elements.

15. The method of claim 14, further comprising:

using an inflating material that shrinks when it sets.

16. The method of claim 15, further comprising:

using said greater thickness for compensation for said shrinkage.

17. The method of claim 16, further comprising:

reinforcing said element for anchoring with ribs extending at least over a majority of its length; and exposing said ribs on said element for anchoring so they contact the cased borehole.

18. A method of sealing a cased borehole, comprising:

providing on a body an inflatable packer with a discrete inflatable element for sealing and a separate inflatable element for anchoring;

running in said body into position; and inflating both elements;

using an inflating material that shrinks when it sets;

providing a greater thickness on said inflatable element for sealing as compared to said element for anchoring;

using said greater thickness for compensation for said shrinkage;

reinforcing said element for anchoring with ribs extending at least over a majority of its length;

exposing said ribs on said element for anchoring so they contact the cased borehole;

providing ribs on said element for sealing which extend from at least one end and short of the midpoint of said element for sealing.

19. The method of claim 18, further comprising:

embedding said ribs on said element for sealing while extending them from each end to leave a large central section thereof without ribs.

* * * * *